US008959731B2

(12) United States Patent
Lynch

(10) Patent No.: US 8,959,731 B2
(45) Date of Patent: Feb. 24, 2015

(54) MEMORIAL URN

(71) Applicant: Lindsay Lynch, Casselberry, FL (US)

(72) Inventor: Lindsay Lynch, Casselberry, FL (US)

( * ) Notice: Subject to any disclaimer, the term of this patent is extended or adjusted under 35 U.S.C. 154(b) by 0 days.

(21) Appl. No.: 13/938,481

(22) Filed: Jul. 10, 2013

(65) Prior Publication Data

US 2015/0013123 A1 Jan. 15, 2015

(51) Int. Cl.
*A61G 17/00* (2006.01)
*A61G 17/08* (2006.01)

(52) U.S. Cl.
CPC ..... *A61G 17/08* (2013.01)
USPC ..... 27/1; 431/291

(58) Field of Classification Search
USPC ..... 27/1, 35; 52/128, 134, 136; 211/85.27; 40/124.5; 431/288, 291, 298; D99/5
See application file for complete search history.

(56) References Cited

U.S. PATENT DOCUMENTS

| | | | | |
|---|---|---|---|---|
| 5,683,239 | A * | 11/1997 | Cardosi | 431/291 |
| 5,813,098 | A * | 9/1998 | Schneider | 27/1 |
| 6,023,822 | A * | 2/2000 | Luebke | 27/1 |
| 6,161,268 | A * | 12/2000 | Joseph | 27/35 |
| 6,520,606 | B1 * | 2/2003 | Robinson | 312/111 |
| 6,785,939 | B1 * | 9/2004 | James | 27/1 |
| 6,904,721 | B1 * | 6/2005 | Forbes | 52/103 |
| 7,036,195 | B2 * | 5/2006 | Glass | 27/1 |
| 7,174,611 | B1 * | 2/2007 | Rose et al. | 27/1 |
| 7,178,209 | B1 * | 2/2007 | Radziewicz | 27/1 |
| 7,987,564 | B2 * | 8/2011 | Leeder | 27/1 |
| 8,046,881 | B2 * | 11/2011 | Johnson et al. | 27/1 |
| 8,146,216 | B2 * | 4/2012 | Creager | 27/1 |
| 2006/0179623 | A1 * | 8/2006 | Robinson | 27/1 |
| 2010/0043187 | A1 * | 2/2010 | Steuer et al. | 27/1 |
| 2014/0047683 | A1 * | 2/2014 | Cooke et al. | 27/1 |

* cited by examiner

*Primary Examiner* — William Miller
(74) *Attorney, Agent, or Firm* — Jason T. Daniel, Esq.; Daniel Law Offices, P.A.

(57) ABSTRACT

A memorial urn includes a central core having at least one vessel stored therein, the vessel functioning to house and identify cremated remains. A plurality of commemoratory items are secured to the central core and a protective outer shell having a plurality of indicia are secured around the core and commemoratory items. A candleholder is positioned onto the outer coating and functions to receive any number of conventional candles.

16 Claims, 7 Drawing Sheets

MEMORIAL URN

TECHNICAL FIELD

The present invention relates generally to urns, and more particularly to a memorial urn which can be customized to celebrate the life of a loved one.

BACKGROUND

The statements in this section merely provide background information related to the present disclosure and may not constitute prior art.

Since the dawn of recorded history, man has endeavored to maintain a link between themselves and their deceased loved ones. This is typically accomplished through the use of a memorial such as a headstone, statue, or other such monument. These monuments are typically located adjacent to the burial site of the deceased, and serve as a permanent reminder to the legacy of a loved one. However, owing to increased concern for health conditions around cemeteries, the ever-increasing costs of earth burials, and the increasingly scarce availability of burial space, cremation has become a widely popular alternative to the more traditional whole-body interment.

To this end, the cremated remains of an individual are typically placed within a vessel such as an urn, for example, prior to being returned to a family member or loved one. At this point, the family members must decide what to do with the ashes. For example, many cemeteries offer patrons the option of purchasing a burial space that is specifically designed for the internment of cremated remains, while other families choose to scatter the ashes of their loved ones. Still others opt to remember their loved ones by keeping the urn containing the cremated ashes in their homes.

However, until now these urns have been generally unsatisfactory because they are readily identifiable as an urn, offer mere token customization options, and do not generally convey a suitable and enduring monument to the departed which can remain with families for generations to come.

Accordingly, the need exists for a memorial urn which can be custom crafted to create a unique and lasting tribute to a loved one that includes a sealed compartment for securely and permanently housing the cremated remains.

SUMMARY OF THE INVENTION

The present invention is directed to a memorial urn. One embodiment of the present invention can include a central core having at least one vessel stored therein, the vessel functioning to house and identify cremated remains. A plurality of commemoratory items can be secured to the central core and a protective outer shell which includes any number of indicia can be secured around the core and commemoratory items. A candleholder can be provided onto the outer coating and can function to receive any number of conventional candles.

Another embodiment of the present invention can include a lagoon candleholder suitable for receiving water and floating candles.

Yet another embodiment of the present invention can include a plurality of vessels stored within the central core.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
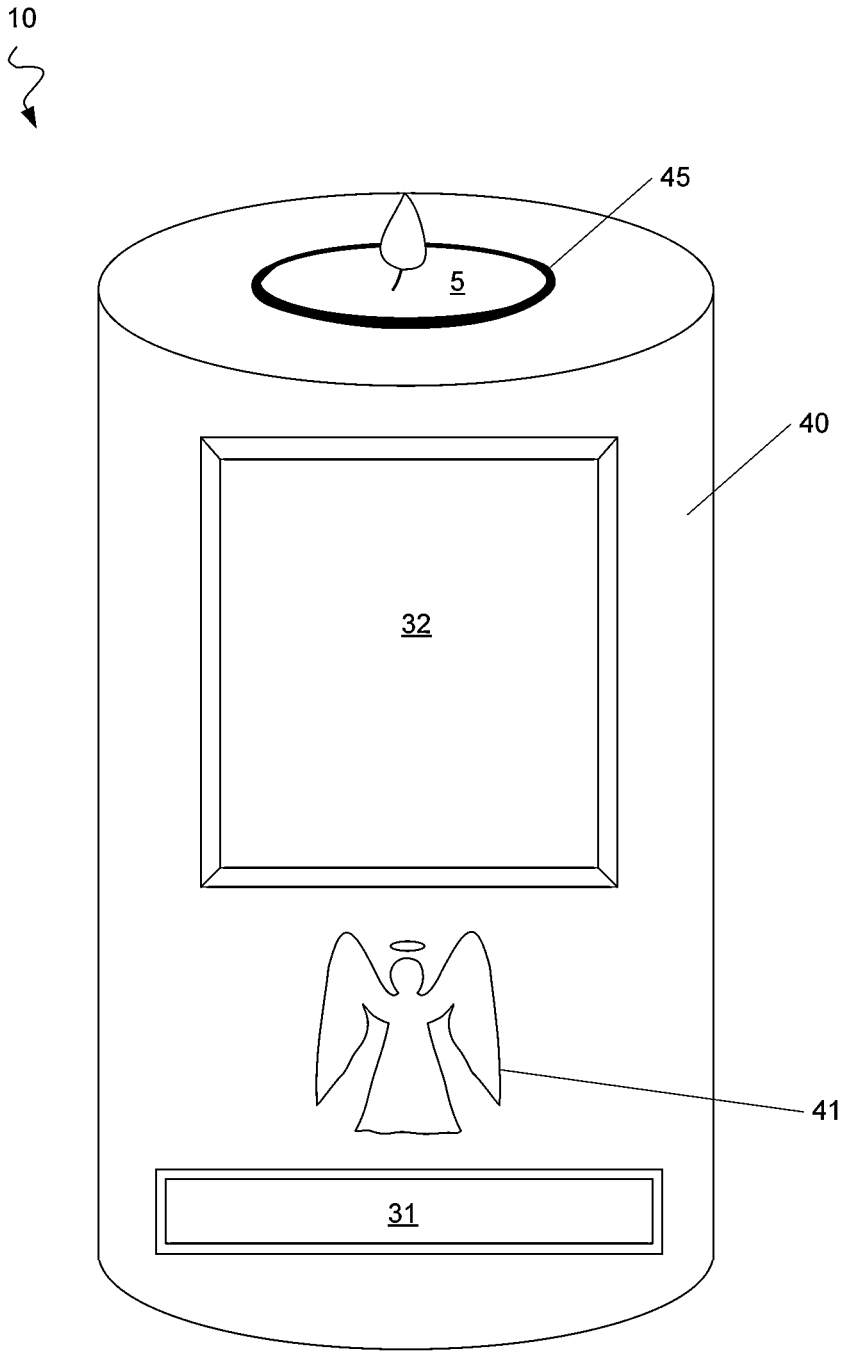
FIG. 1 is a perspective view of a memorial urn in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Although described throughout this application as pertaining to human remains, the inventive concepts disclosed herein are equally applicable to nonhuman remains, without limitation.

FIG. 1 illustrates one embodiment of a fully assembled memorial urn 10 that is useful for understanding the inventive concepts disclosed herein. As will be described below, the memorial urn 10 can include a central core 20, at least one containment vessel 25, any number of commemorative items, an outer body 40 and a candleholder 45.

Figure 2A:
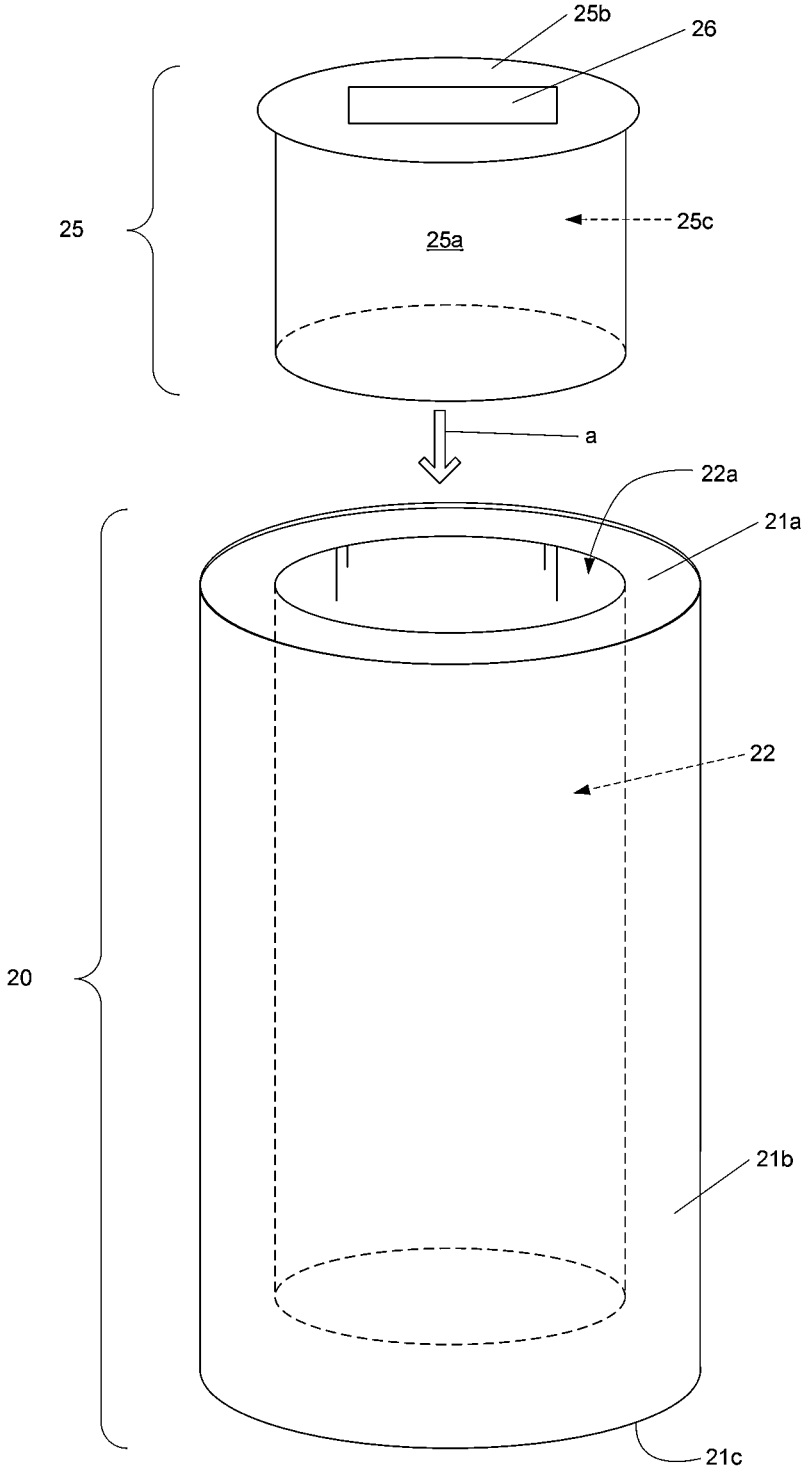
FIG. 2*a* is an exploded parts view of a central core and a vessel of the memorial urn, in accordance with one embodiment of the invention.

As shown in FIG. 2*a*, the central core 20 can preferably include a generally cylindrical construction having a top end 21*a*, a middle section 21*b* and a capped bottom end 21*c*, that is hand crafted from candle wax. An elongated channel 22 having an opening 22*a* can extend downward from the top end 21*a*, and can function to receive and hold one or more vessels 25 (see arrow a) containing the cremated remains.

Although described with respect to a particular material, those of skill in the art will recognize that the core 20 can be constructed from any number of other conventional materials capable of being produced to a specific size and shape, these materials including plastic, for example, PVC and metal such as aluminum or stainless steel.

The vessel 25 can preferably include a generally cylindrical main body 25*a* and a permanent or removable lid section 25*b* defining a generally waterproof and airtight chamber 25*c* for receiving and permanently storing cremated ashes. A permanent label 26, engraving, or other such marking can be secured along one end of the vessel 25 to provide information pertaining to the deceased, such as name, date of birth, and date of death, for example.

Although described as including a single vessel, this is for illustrative purposes only. To this end, the central core can function to receive between approximately 1 and 3 individual vessels 25, each having any number of different shapes and sizes that are suitable for being housed within the elongated channel 22 of the central core. Moreover, the vessel 25 can be constructed from any number of sturdy materials such as plastic, composites, and metals such as steel and aluminum, for example. Additionally, the lid 25*b* can be hermetically and permanently affixed to the main body 25*a* via welds, or through the use of adhesives. By permanently sealing the ashes within a secure vessel having a non-removable identification device 26, the inventive concepts advantageously provide security to a loved one that, in the unlikely event the main body 20 and/or outer shell 40 is ever ruptured or otherwise damaged, the ashes and vessel 25 will remain intact.

Figure 2B:
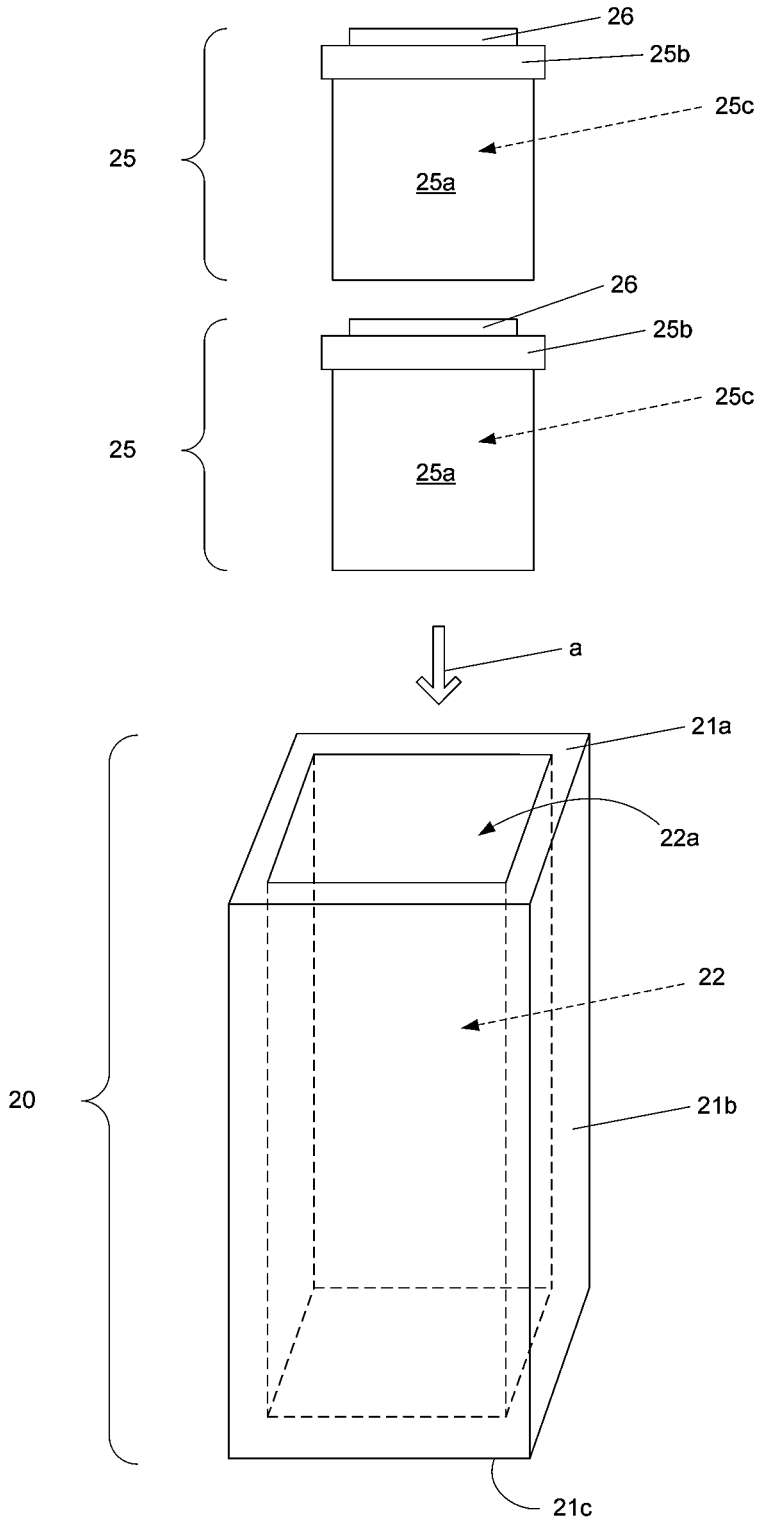
FIG. 2*b* is an exploded parts view of another central core and a pair of vessels of the memorial urn, in accordance with another embodiment of the invention.

Although described above as including generally cylindrical components, other embodiments which include different shapes are also contemplated, as evidenced by FIG. 2*b*. To this end, one or more of the core body 20, the elongated channel 22 the vessel(s) 25 and the outer body 40 (described below) can include any number of different shapes and dimensions.

Figure 3:
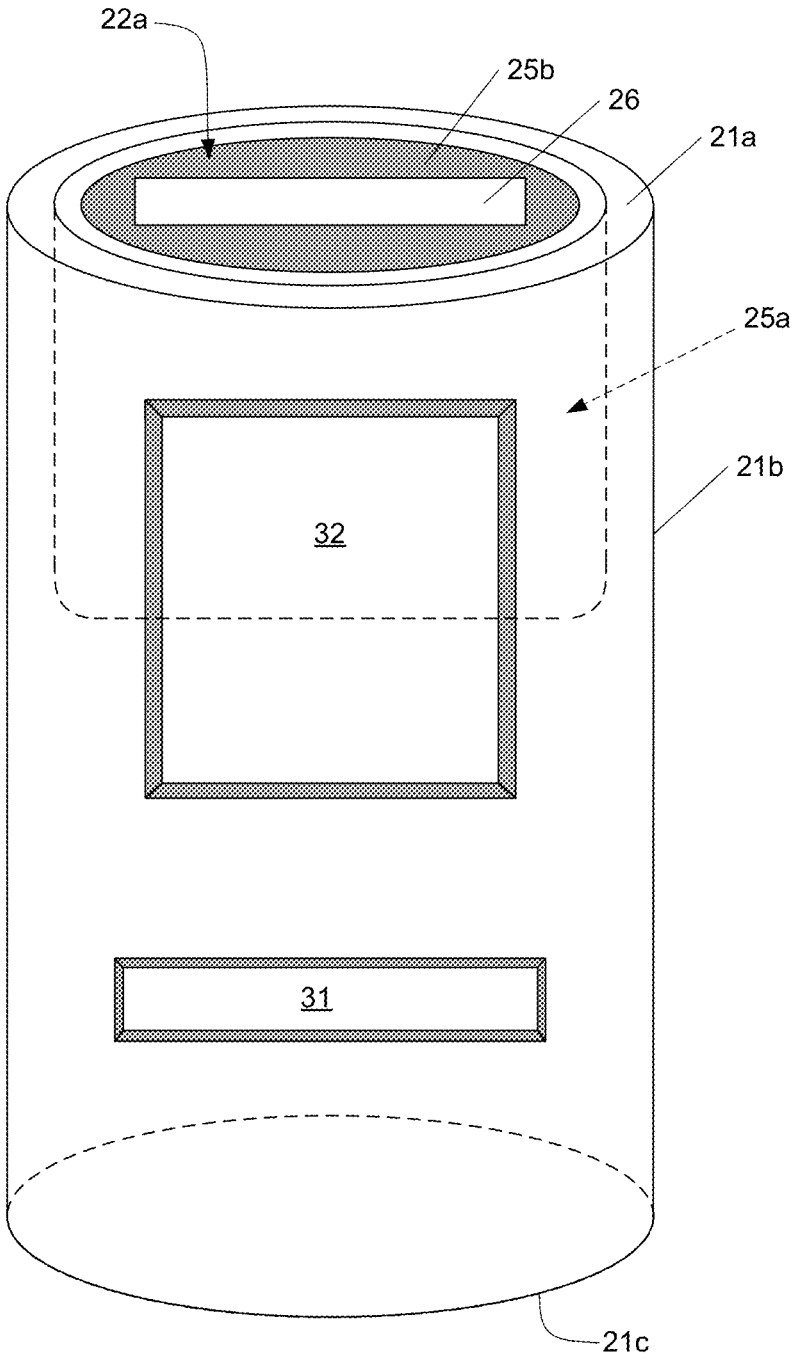
FIG. 3 is a perspective view of the assembled core of the memorial urn, in accordance with another embodiment of the invention.

As shown in FIG. 3, any number of commemoratory items such as an engraved plaque 31 and/or photographs 32, for example, can be affixed to the main body of the central core 20. As described herein, the plaques can include any type of materials such as bronze, gold plated metal, glass, and/or acrylic, for example. Each of the images and/or plaques can be adhered to the core body utilizing adhesives such as glue or double-sided tape, for example.

Figure 4A:
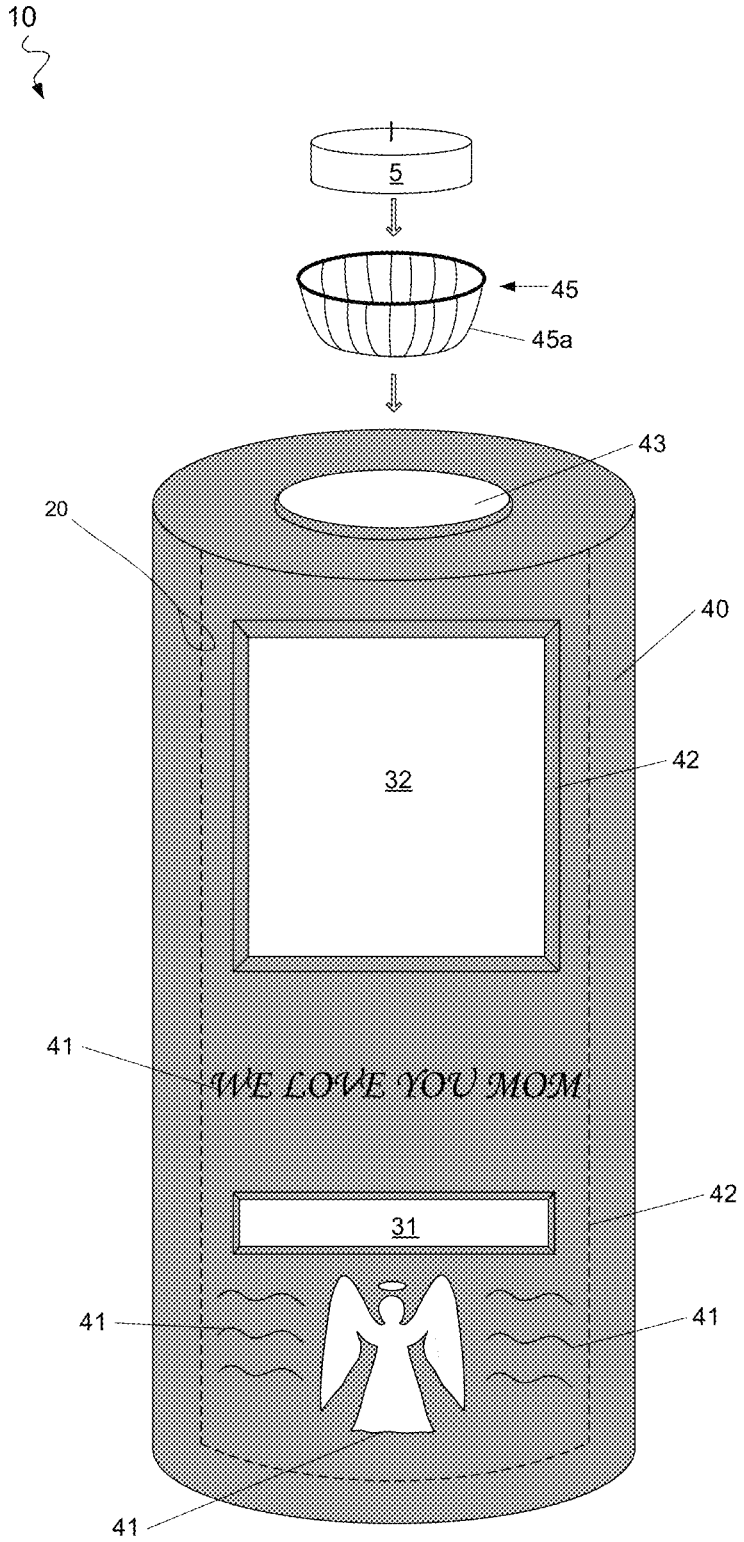
FIG. 4*a* is an exploded parts view of the memorial urn, in accordance with one embodiment of the invention.
Figure 4B:
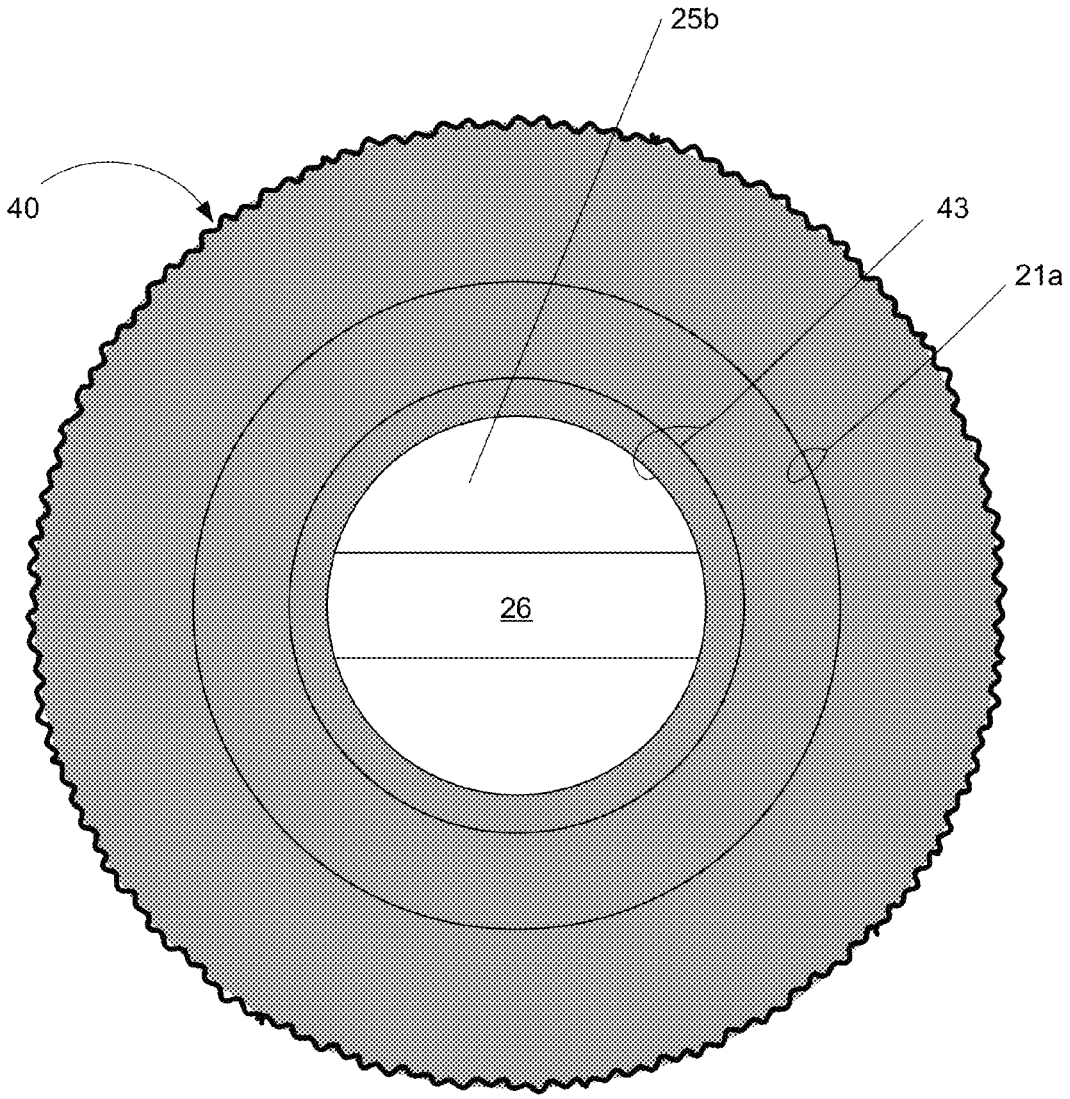
FIG. 4*b* is a top view of the memorial urn, in accordance with one embodiment of the invention.
Figure 4C:
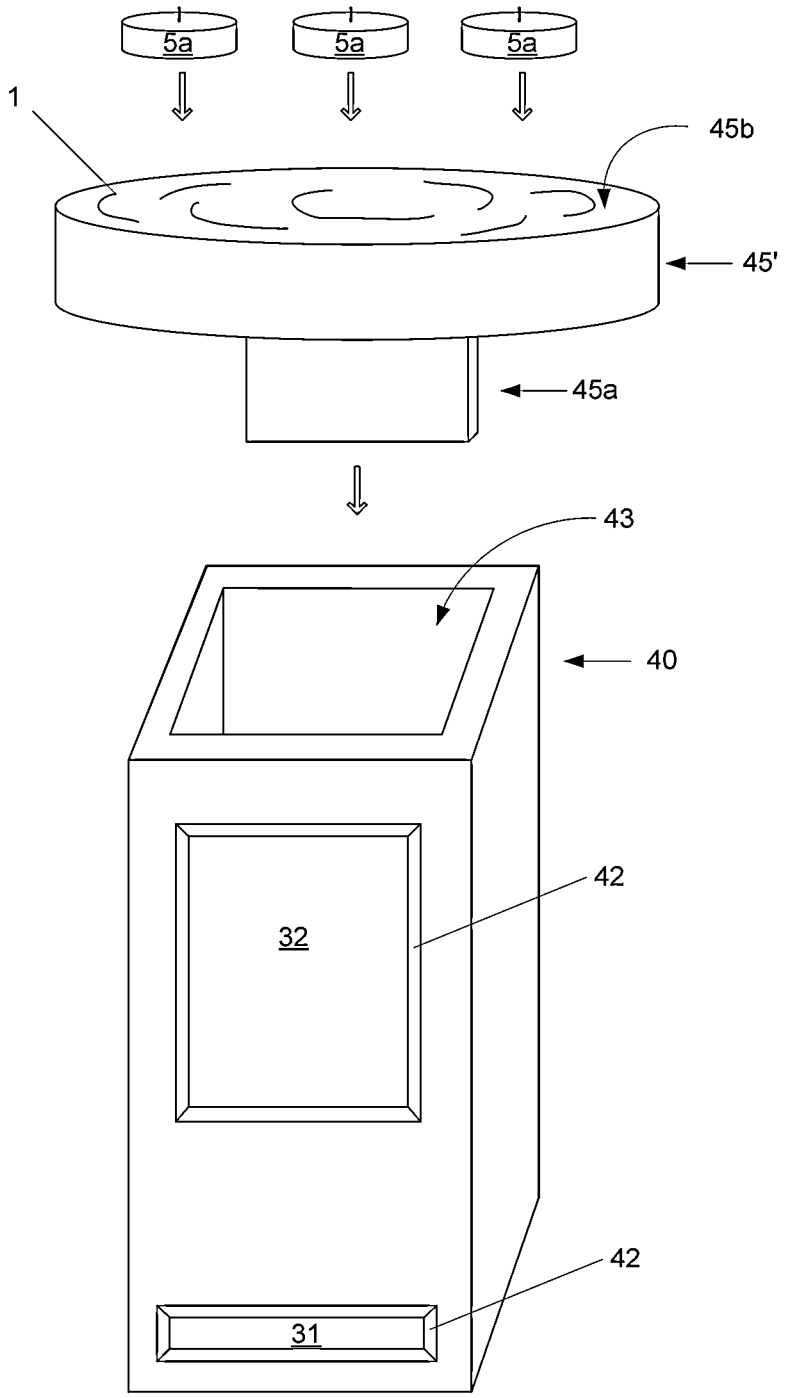
FIG. 4*c* is an exploded parts view of the memorial urn, in accordance with another embodiment of the invention.

As shown in FIGS. 4*a*-4*c*, the memorial urn 10 further includes a protective and/or decorative outer shell 40 that functions to encompass the central core 20. The outer shell can include any number of different shapes and dimensions, and can further include any number of indicia 45.

In the preferred embodiment, the outer shell 40 can also include a generally cylindrical shape that is constructed from candle wax that has been hand applied to the central core 20. As shown, the outer shell 40 can include a plurality of openings 42 having any number of different shapes and sizes suitable for allowing one or more of the plaques 31 and images 32 to remain visible, although the corners of each may be covered to ensure these items remain securely affixed to the core. A candleholder opening 43 can also be disposed along the top end of the device in order to receive a candle and to allow the label 26 to remain visible when no candleholder is inserted.

As described herein, the term "indicia" can include any type of decorative elements such as colors, markings, words, shapes, symbols, logos, designs, lights, types of materials, texturing of materials, patterns, images, lithographs and/or additional photographs, for example, this indicia can be provided in accordance with known techniques and can be inlaid onto the main body 40 or can be raised/protruding outward from the outer body 40, so as to give a three dimensional effect.

The memorial urn 10 also including a candleholder 45 having a protruding bottom portion 45*a* that has a complementary shape and dimension to the shape and dimension of the opening 43. The candleholder 45 further including a generally hollow central portion having any number of different shapes and sizes suitable for receiving any number of conventional candles 5 such as a tea light candle, for example, and can preferably be constructed from a strong, generally fireproof/fire resistant material such as steel or aluminum, for example.

As shown best in FIG. 4*c*, the candleholder can also be constructed to include a large waterproof body 45*b* capable of receiving and holding water 1. In this manner, the "lagoon" candleholder 45' can function to receive a plurality of floating candles 5*a*, thereby further enhancing the memorial. The lagoon candleholder preferably including a glass or clear plastic construction to enable viewing of the water 1 and/or floating candles 5*a* from an angle.

By positioning a separate fire resistant holder 45 between the outer body 40, the central core 20 and the vessel 30, the memorial urn 10 advantageously functions to direct any heat produced from the candle away from the urn 10. Moreover, the combination of a standard removable wax candle 5 and a fireproof candleholder 45 can be particularly beneficial in instances where a user forgets to extinguish a burning candle before leaving the memorial urn unattended. To this end, the candleholder 45 can continue to direct heat away from the device until the candle self-extinguishes, thereby preventing damage to the urn.

As described herein, one or more elements of the memorial urn 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that any number of different individual elements may be formed together as one continuous element, either through manufacturing processes, such as welding, casting, or molding, or through the use of a singular piece of material milled or machined with the aforementioned components forming identifiable sections thereof.

Additionally, the memorial urn 10 as described above can be attached to or secured within any number of other products, such as a rocking chair, a grandfather clock, a mantle or other such fixture through any known connection means such as a bracket, for example. Accordingly, the memorial urn 10 is not to be construed as only a standalone embodiment.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A memorial urn for storing cremated remains, comprising:

a central core having an elongated, generally hollow channel disposed therein;

a core opening disposed along a top end of the central core, said opening being in communication with the hollow channel;

a vessel disposed within the elongated hollow channel, said vessel having an airtight and waterproof chamber that is configured to receive and store the cremated remains, and including a permanent identification marking thereon, one or more commemoratory items secured to the central core;

an outer shell that is secured to the central core, said shell including one or more shell openings having a size, shape and location that is complementary to each of the one or more commemoratory items such that each of the one or more commemoratory items are visible;

a candleholder opening disposed along an upper portion of the outer shell at a location in line with the permanent identification marking, and a generally fire resistant candleholder that is configured to be positioned within the candleholder opening, said candleholder having a shape that is conducive to receiving a candle and directing any heat produced from the candle away from the urn.

2. The memorial urn of claim 1, wherein the identification marking is visible via the central core opening.

3. The memorial urn of claim 1, wherein the identification marking is visible via each of the core opening and the candleholder opening.

4. The memorial urn of claim 1, wherein said commemoratory items include one of a plaque and a photograph.

5. The memorial urn of claim 1, wherein said commemoratory items include each of a plaque and a photograph.

6. The memorial urn of claim 1, further comprising:

a plurality of raised indicia that is disposed along the outer shell.

7. The memorial urn of claim 1, further comprising:

a plurality of inlaid indicia that is disposed along the outer shell.

8. The memorial urn of claim 1, wherein said identification marking comprises a label that is permanently adhered to the vessel.

9. The memorial urn of claim 1, wherein said identification marking comprises an engraving onto a surface of the vessel.

10. The memorial urn of claim 1, wherein said vessel is configured to be permanently sealed upon receipt of the cremated remains.

11. The memorial urn of claim 1, further comprising a plurality of the vessels, each secured within the elongated channel of the central core.

12. The memorial urn of claim 1, wherein each of said central core and outer shell includes a generally cylindrical construction.

13. The memorial urn of claim 1, wherein each of said central core and outer shell are constructed from hand crafted candlewax.

14. The memorial urn of claim 1, wherein each of said central core and outer shell are constructed from at least one of plastic, metal and candlewax.

15. A memorial urn for storing cremated remains, comprising:

a central core having an elongated, generally hollow channel disposed therein;

a core opening disposed along a top end of the central core, said opening being in communication with the hollow channel;

a vessel disposed within the elongated hollow channel, said vessel having an airtight and waterproof chamber that is configured to receive and store the cremated remains, and including a permanent identification marking thereon, one or more commemoratory items secured to the central core;

an outer shell that is secured to the central core, said shell including one or more shell openings having a size, shape and location that is complementary to each of the one or more commemoratory items such that each of the one or more commemoratory items are visible;

a candleholder opening disposed along an upper portion of the outer shell at a location in line with the permanent identification marking, and a lagoon candleholder having a lower portion that is configured to be positioned within the candleholder opening, said lagoon candleholder having a waterproof body configured to receive and hold water and a plurality of floating candles.

16. The memorial urn of claim 15, wherein said lagoon candleholder is constructed from at least one of glass and clear plastic.

* * * * *